US005606910A

United States Patent [19]

Katz

[11] Patent Number: 5,606,910

[45] Date of Patent: Mar. 4, 1997

[54] PRESS-DRIVEN TOOL MODULE IN PARTICULAR PRESS-DRIVEN CROSS-PUNCHING OR BENDING UNIT

[75] Inventor: Wolfgang Katz, Dauchingen, Germany

[73] Assignee: Danly Corporation, Coconut Grove, Fla.

[21] Appl. No.: 416,703

[22] PCT Filed: Apr. 26, 1993

[86] PCT No.: PCT/DE93/00370

§ 371 Date: Dec. 11, 1995

§ 102(e) Date: Dec. 11, 1995

[87] PCT Pub. No.: WO94/25260

PCT Pub. Date: Nov. 10, 1994

[51] Int. Cl.[6] ..... B30B 1/32

[52] U.S. Cl. ..... 100/208; 72/453.18; 83/588; 100/257; 100/269.05; 100/269.18; 100/271

[58] Field of Search ..... 100/257, 259, 100/266, 270, 271, 269.05, 269.18, 208; 72/453.01, 453.18, 453.03; 83/588

[56] References Cited

U.S. PATENT DOCUMENTS

| | | | |
|---|---|---|---|
| 3,089,375 | 5/1963 | Williamson | 83/588 |
| 3,244,051 | 4/1966 | Williamson | 83/588 |

FOREIGN PATENT DOCUMENTS

| | | | |
|---|---|---|---|
| 0251796 | 1/1988 | European Pat. Off. . | |
| 2348051 | 11/1977 | France . | |
| 2600948 | 4/1984 | Germany | 72/453.03 |
| 60-40621 | 3/1985 | Japan . | |

*Primary Examiner*—Stephen F. Gerrity
*Attorney, Agent, or Firm*—Dominik & Stein

[57] ABSTRACT

A press-driven tool module comprising a foundation body including a cylindrical bore; a work ram slidably mounted in the cylindrical bore of the foundation body for sliding movement in non-vertical reciprocal operating and return directions, the ram adapted for receiving a work tool, wherein the work ram is a piston rod of a hydraulic medium activated work piston, and wherein the work piston is slidably mounted in a work space of a work cylinder; a return spring element disposed for urging the ram in the return direction; a hydraulic power cylinder having a displacement space containing hydraulic medium; a vertically displaceable plunger mounted in the hydraulic power cylinder for acting upon the hydraulic medium; and a press ram disposed for acting upon the plunger; a hydraulic pressure line communicating between the displacement space of the power cylinder and the work space of the work cylinder, wherein a supply space is provided in the power cylinder for the hydraulic medium, which supply space, when the plunger is at the upper top dead center, is in communication with the displacement space of the power cylinder, and which supply space is otherwise sealed off from the displacement space by high pressure seal means.

15 Claims, 3 Drawing Sheets

PRESS-DRIVEN TOOL MODULE IN PARTICULAR PRESS-DRIVEN CROSS-PUNCHING OR BENDING UNIT

BACKGROUND OF THE INVENTION

1. Field of the Invention

The invention concerns a press-driven tool module, in particular a press-driven cross-punching or bending unit comprising a work ram slidably mounted in a cylindrical bore and adapted for receiving a work tool, a hydraulic power cylinder, a vertically displaceable plunger mounted in said hydraulic power cylinder, and a press ram disposed for acting upon said plunger, and a hydraulic pressure line communicating between the power cylinder and the work cylinder, such that the press ram acting on the plunger causes transmission of pressure through the hydraulic lines to said work cylinder.

2. Description of the Related Art

This type of work tool module is known for example from the brochure "MILFAB" of Danly Deutchsland GmbH. It is comprised of a ram or pushrod onto which a work tool, in particular a cross-punching or bending tool, is provided. The ram is mounted slidably in a guide box within a foundation. The direction of sliding is determined by the orientation of the guide box and runs horizontally. Parallel to the ram, either within or outside of the foundation, a coil spring is provided connected with the ram in such a manner that it opposes the sliding action of the ram and serves as a return spring. The end the ram opposite the work tool end is acted upon by a rocker arm. This is mounted pivotally in the foundation and is vertically acted upon by a press ram. As a result of the downward movement of the press ram during the operating stroke, the rocker arm pivots about its axis and thereby pushes the work tool carrying ram in the forwards direction. After the cross-punch or bending process there follows the return stroke of the press ram as well as the return movement of the work tool carrying ram as a result of the operation of the return spring. The return spring is necessary for the reason that the press ram is not rigidly connected with the tilt lever. More particularly, the press ram has, when at top dead center, no contact with the rocker arm.

This type of work tool module has found wide acceptance since it is universally capable of being incorporated in all conventional presses. It is mounted therein in the desired position. For this, various means of securing such as, for example, bore holes, adjusting spring slots or recesses, are provided in the foundation.

Nevertheless, they exhibit a series of disadvantages. It is necessary that the rocker arm acting as a force redirecting organ is subject to very strong wear forces, since the transference of high forces must occur at the pivot axis. The same can be said for the sliding surfaces of the rocker arm lever which are in contact with the press ram and with the tool carrying ram. Further, this type of work tool module has little flexibility with respect to possibilities of multi-unit arrangements. In the case that it is desired to provide a multi-unit arrangement, there is little flexibility since as a rule only one rocker arm can be operated respectively by a press ram. For this reason an expensive and complicated construction is frequently necessity in order to permit multiple work tools to be operated at the same time using one main rocker arm. Once a particular geometric construction has been selected it must as a rule be maintained; even minimal modifications in the geometry result in the need for special customized construction of a new work tool module.

SUMMARY OF THE INVENTION

The present invention is thus concerned with a problem of providing a press-driven tool module of the type known in this art and to improve it such that it no longer suffers from the above-described disadvantages. In particular, a press-driven work tool module should be constructed with which the force transference, that is, the transfer of the vertical force input from the press ram to therefrom departing direction, is possible and at the same time a high measure of flexibility is possible.

This problem is solved by a press-driven tool module comprising a foundation body including a cylindrical bore; a work ram slidably mounted in the cylindrical bore of the foundation body for sliding movement in non-vertical reciprocal operating and return directions, the ram adapted for receiving a work tool, wherein the work ram is a piston rod of a hydraulic medium activated work piston, and wherein the work piston is slidably mounted in a work space of a work cylinder; a return spring element disposed for urging the ram in the return direction; a hydraulic power cylinder having a displacement space containing hydraulic medium; a vertically displaceable plunger mounted in the hydraulic power cylinder for acting upon the hydraulic medium; and a press ram disposed for acting upon the plunger; a hydraulic pressure line communicating between the displacement space of the power cylinder and the work space of the work cylinder, wherein a supply space is provided in the power cylinder for the hydraulic medium, which supply space, when the plunger is at the upper top dead center, is in communication with the displacement space of the power cylinder, and which supply space is otherwise sealed off from the displacement space by high pressure seal means.

BRIEF DESCRIPTION OF THE DRAWINGS

The invention will now be further discussed with respect to the figures in which an illustrative example according to the invention is schematically represented. Further advantages are also to be from the details. There are shown.

DETAILED DESCRIPTION OF THE INVENTION

Figure 1:
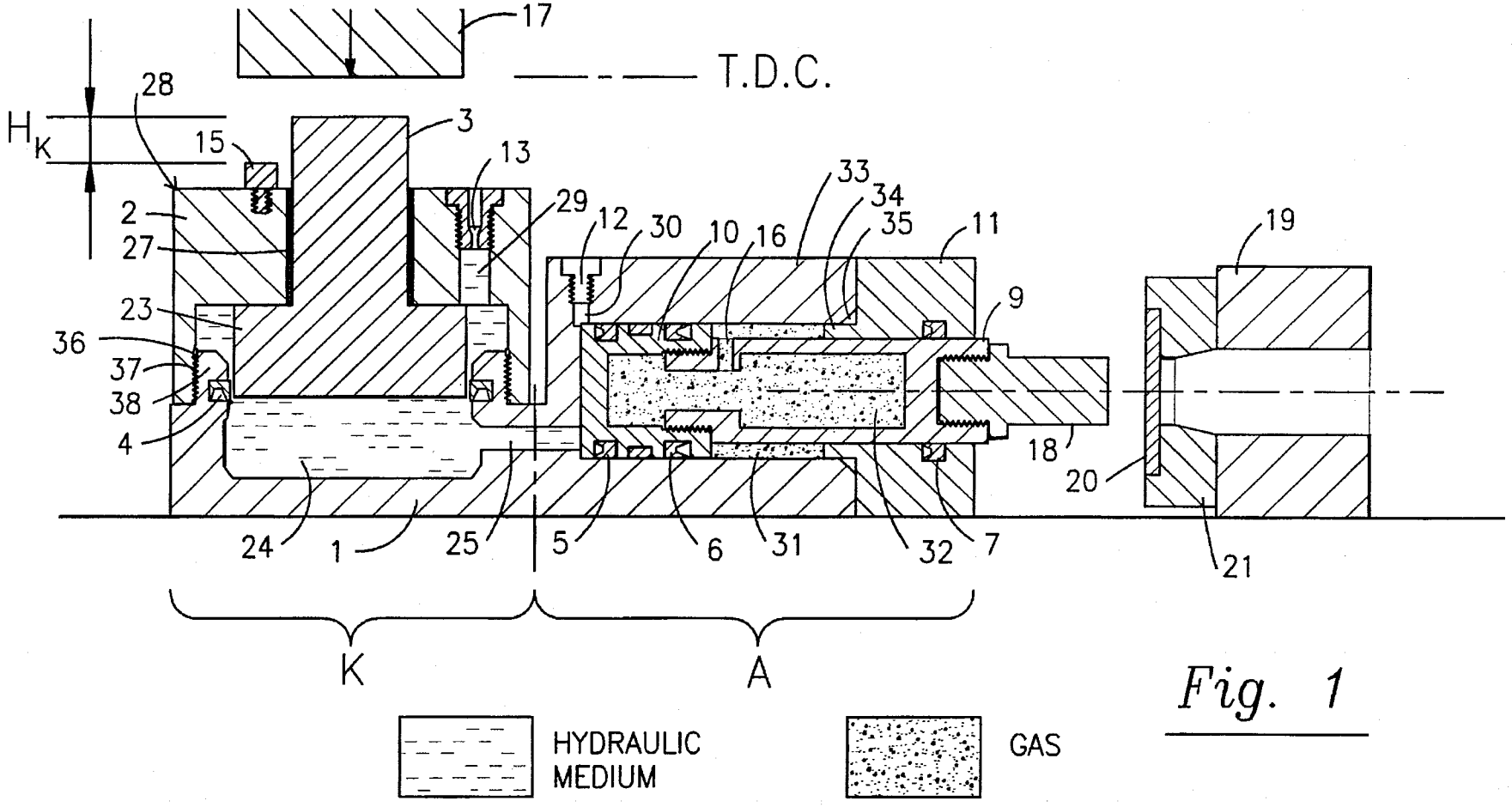
FIG. 1 a cross-sectional representation of the work tool module, press piston at top dead center.

The invention is based upon the realization that the force transfer should not to be realized mechanically but rather hydraulically. For this, the kinetic energy of a press ram is used to place a hydraulic medium for a short period of time under high pressure so that the desired cross-punching or bending can be carried out.

Although it is already known, for example, from DE 26 00 948 B2, to use a hydraulic cylinder for bending, wherein a piston slidable in a cylinder is connected with a work tool carrying piston rod. For power transmission a hydraulic fluid is used, which is placed under pressure from a separate hydraulic control unit. This type of hydraulic control unit is, however, not driven by a press, but rather includes as a rule an electro-motor. In order to apply the static pressure for the press cross-punching or bending process, it is necessary to engineer in very high output capability. This is not economical, since the maximal pressure for processing is required for only for a short period, that is, as an impulse. For this reason the above-mentioned publication suggests an expensive construction, which by means of an controlled impact type helper piston achieves high pressure by the release of staggered energy. Besides the necessary high technical expenditure, this type of assembly cannot be driven by means of the presently available presses, but rather requires a complete reconfiguration of the work station with hydraulic control systems.

In comparison to this, it is a characteristic of the present invention that the existing press can continue to be used, so that a flexible restructuring by the adding on of additional work modules as required, even conventional modules, is made possible.

In particular, according to a preferred inventive embodiment, there is provided an inventive work tool module which provides the possibility of separating the work tool carrying work unit from the power unit which places the hydraulic medium under pressure, wherein both components are connected via a high pressure line. In this way it is possible at the same time to operate a multiplicity of working units via a single power unit. The position of each work unit can be changed without any significant expenditure. In particular, it is made possible to that the work processing be realized not only strictly horizontally, but rather also departing therefrom in any desired angle.

Further, the operation of the work tool module is exceptionally simple since the hydraulic medium is essentially supplied into the power unit without any pressurization, and is essentially placed under high pressure for respectively only short periods of time.

In a particular preferred embodiment of the invention a gas cylinder element is integrated in the work unit to serve as a return spring, which is integrated within the cylinder space or, as the case may be, within the piston and the piston rod, without additional space requirement. In certain cases where only a relatively minor amount of return pressure is required, a spiral spring can also be provided as a cost effective alternative.

The work tool module is comprised of two components, namely the work cylinder A and a power cylinder K. The work cylinder A is comprised of a foundation body 33 with a cylindrical bore. In the cylindrical bore a work piston 10 is slidably mounted. A piston rod 9 is provided on the work piston 10, and on its end side there is a work tool 18 in the form of a stamp. The piston rod 9 is likewise slidably mounted in a guide box 11, which closes off the foundation body 33. The guide box 11 is screwed into the foundation body 33. The guide box 11 projects with an inset fitting 34 into the inside of the cylinder or of the foundation body 33. A sealing ring 35 provided in the overlapping area between the foundation body 33 and the guide box 11, of which the function is further described below. The sliding path of the work piston 10 is on the one hand limited by abutment against the end of the foundation body 33 and on the other hand by abutment on the inset fitting 34 of the guide box 11. The distance between these two end points is the stroke $H_a$ of the work piston 10 and corresponds therewith to the value of the maximal displacement of the work tool 18. At the same time the work space 22 is defined as the corresponding axial segment of the cylinder bore of the foundation body 33.

The work piston 10 is provided with a high pressure sealing fitting means 5, so that the work space 22 is sealed against high pressure in this position between the work piston 10 and the cylinder bore of the foundation body 33.

The power cylinder K comprises a base block 1, upon which the guide block 2 is mounted and with which it is tightly screwed together. The guide block 2 has a passage bore hole, in which the slide box 27 is seated. The slide box 27 guides the piston rod 3, which is securely mounted on plunger 23. The bore which receives the piston rod 3 extends into the inner side of the guide block 2 into a cylindrical bore hole of greater cross-section, which itself is provided with inner threading 36. The inner threading 36 is in engagement with an outer winding 37 provided on an upwardly directed sleeve ring 38 of the base block 1.

In the base block a cylindrical bore hole is provided, which essentially represents the displacement space 24 and passes upwardly into the cylindrical bore of the guide block 2. The cross-section of the cylinder bore of the guide block 2 is greater than the outer diameter of the plunger 23 so that between the plunger 23 and the guide block 2 a torus space 26 remains. In the vicinity of the sleeve 38 the cross-section of the cylinder bore comes to correspond to the cross-section of the plunger 23.

Further on downwards the cross-section of the cylinder of the base block 1 increases very slightly and forms a kind of recess. From here on the bore 25 proceeds to connect the displacement space 4 with the work space 22 of the work cylinder A. The displacement space 24, the connecting bore 25, the work space 22, as well as parts of the torus space 23, are all filled with hydraulic medium M. For this there is used an oil of medium viscosity.

Figure 2:
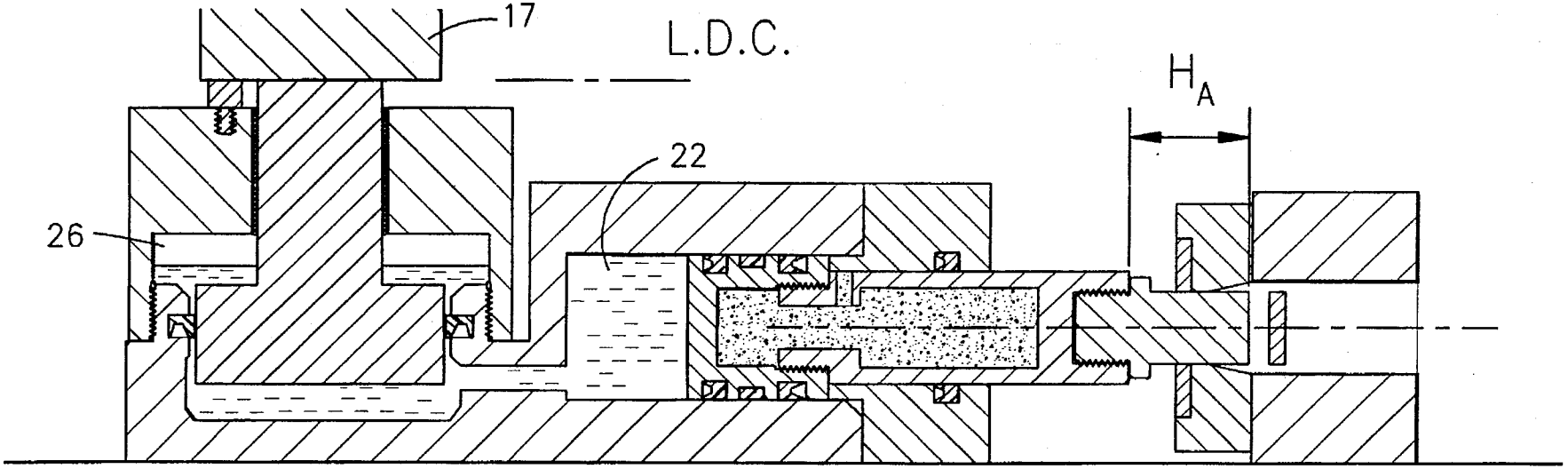
FIG. 2 a sectional representation of the work tool module, press piston at bottom dead center.

When the position of the plunger 23 is as schematically shown in FIG. 1, the torus space 26 is in communication with the displacement space 24, so that a fluid passage extends from displacement space 24 to torus space 26. In this position hydraulic medium M can be supplied via a here not shown fill vent 14. For simplification of the filling process a ventilation bore hole 30 is provided in communication with the work space 22, which is securely closed off with a ventilation screw 12. Upon filling the fluid upper surface climbs upwardly in the power cylinder upwardly, until finally the entire torus space 26 is filled and therewith has the function of a supply chamber for the hydraulic medium M. In a different position of the displacement piston 23, as it is for example shown in FIG. 2, the supply chamber 26 is segregated from the displacement space 24. For this, a high pressure-ring sealing means 4 is provided which is seated in the sleeve 38 of the base block 1 and tightly encompasses the plunger 23.

A sealed gas element is integrated in the work cylinder A. For this a torus space is used, which lies in radial direction between the piston rod 9 and the cylinder bore of the work cylinder A and an axial direction between the work piston 10 and the guide box 11. This range is constructed to be gas tight by provision of the work piston 10 with a gas tight seal 6 and the guide box 11 with a gas tight seal 7, which seals the transition from the piston rod 9 to the guide box 11. Further, the above-mentioned sealing ring 35 seals the transition between the foundation body 33 to guide box 11. The torus space 31 is filled with nitrogen under high pressure. A sliding of the work cylinder 10 out of the FIG. 1 represented starting position towards the right diminishes the volume of the torus space 31, which compresses the gas found therein. Upon a reduction of load on the work piston 10, the gas expands and urges the work piston 10 back towards its starting position. In order to limit the increase in pressure as a result of the displacement of the torus space 31, the inner of the piston 10 and the piston rod 9 are extensively bored out, so that a common core space 32 results, which communicates with the torus space 31 via a bore 16. Thus the hollow space 32 and the bore 16 are likewise filled with gas. By means of a suitable dimensionalization of the cavity a desired spring characteristic can be achieved. This makes possible an exceptionally compact construction means, since the gas cylinder element is completely integrated into the in side of the work cylinder A.

Filling of gas can take place as necessary through a gas vent which is not shown in greater detail.

The operating means of the work tool module is now discussed in greater detail:

The operating start point at the beginning of the work cycle is shown in FIG. 1. This concerns a stamping press, by means of which a hole is to be stamped in the work piece 20. The work piece 20 is held by means of a female receptacle 21 of which the inner side is secured to a protection plate 19.

A press piston 17 of a hitherto not shown press is at this time at its upward top dead center. The work tool 18 is to be found at this time in its retracted position, whereby the work piston 10 abuts, as a result of the working of the gas cylinder element, on its face side with the inner of the cylinder bore of the foundation body 33. Thereby, by means of the hydraulic medium M, the working piston 23 is held under pressure against the shoulder of the guide block 2. The working piston 23 does not have any contact with the high pressure-ring sealing 4 so that a continuous fluid space results between the work displacement 24 and in the supply space 26.

At this time the striker 17 begins its downward movement and meets the piston rod 3. By the further downward movement of the striker 17 the displacement piston 23 is, via the piston rod 3, vertically forced in the downwards direction. After a short travel it comes in contact with the high-pressure ring-seal 4 so that from that point on the displacement space 24 is sealed off from the supply space 26. Through the further downward movement of the plunger 23 the pressure in the hydraulic medium M increases in the displacement space 24 and in the bore 25. As a result of the increase in pressure the work piston 10 is urged against the operating force of the gas cylinder element and (in the representation according to FIGS. 1 and 2) slid towards the right. The pressure increase in the hydraulic medium M next stops increasing, since essentially the work piston 10 undergoes a displacement movement or a stroke and therewith advances the work tool 18.

At the meeting of the work tool 18 and the work piece 20 the pressure in the hydraulic medium M increases like an impact, since the plunger 23 is forced further downwards via the press ram 17, the work piston 10 however as a consequence of the connecting of the work tool 18 with the work piece 20 is arrested in its position. The pressure continues to increase so long, until the pressure needed for the stamping is built up and the work tool strikes into the female receptacle. The penetration in the female receptacle is limited by the abutment of the work piston on the inset fitting 34 of the guide box 11. This corresponds to the position shown in FIG. 2.

The press ram 17 has now reached its lower position, the lower dead center (LDC) and is in the process of changing its direction of movement and to start moving upwardly. As a result it is made possible for the pressure piston 23 to be returned to its starting position. Since the piston rod 3 is not connected with the press ram 17, the return stroke of the plunger 23 is accomplished by means of the return stroke of the drive piston 10. For this the integrated gas cylinder element is responsible, which was compressed as a result of the displacement of the work cylinder 10, and now can begin the period of expansion. As a consequence of the expansion the work piston 10 is returned so that its face side abuts with the cylinder bore in the foundation body 33, so that it again is returned to the position indicated in FIG. 1.

On the face side of the guide block 2 a height justifiable mechanical limiter 15 is provided, which serves as stroke limiter for the press ram 17 and therewith for the plunger 23. It will prevent the plunger 23 from accidentally penetrating too deeply into the displacement space 24, which would permit the pressure in the hydraulic medium M to climb to an unacceptably high level. Thereby operating problems are practically excluded. In addition, in the areas containing hydraulic medium (M), for example in the realm of the bore 25, a here not shown safety burst plug may be provided.

A pressure equalization bore 29 communicates from above into the supply space 26, which is closed off with a low pressure vent 13. The low pressure vent 13 insures for equalization of pressure, in so far as in the course of displacement of the plunger piston 23 may result in an over- or under-pressurization with respect to predetermined limits. It also prevents an overfilling with hydraulic medium M.

Without functional complication there is also a spatially separated provision of a power cylinder K and work cylinder A possible, wherein the bore 25 via a high pressure line is to be replaced. Also can on the power cylinder K a plurality of work cylinders A be engaged or attached, of which the high pressure lines are either individually or via a multiple connection with the power cylinder coupled. In particular with use of a flexible line as high pressure line there is made possible a completely variable and independent of the design configuration made possible.

In one concrete embodiment the following pressure and dimensions were utilized.

In the position shown in FIG. 1 oil of a medium viscosity under ambient conditions is to be found in the displacement space 24 and the supply space 26. In the gas cylinder element nitrogen gas is provided under a pressure of 100 bar. During the operating cycle the oil pressure increases to a maximum of 400 bar, the pressure in the gas cylinder element reaches approximately 140 bar.

Figure 3:
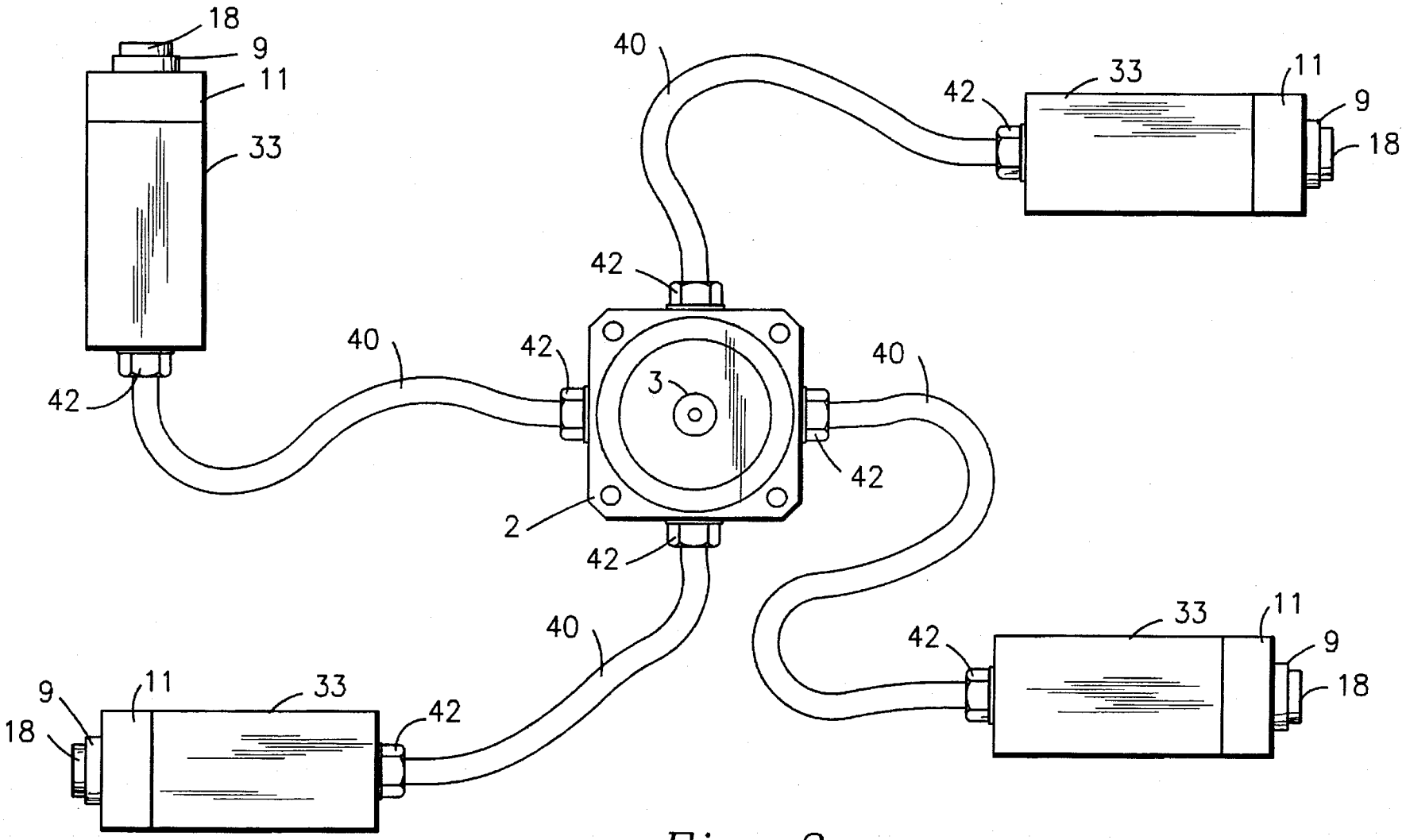
FIG. 3 a press-driven tool module with four work cylinders connected to a single hydraulic power cylinder.

The press-driven tool module with a plurality of work cylinders as shown in FIG. 3 will be now be discussed in detail.

FIG. 3 shows a central power cylinder including guide block 2 and piston rod 3, which power cylinder is connected to four cylinder bores of foundation bodies 33 via flexible high pressure lines 40 attached via threaded couplings 42. By the use of flexible high pressure lines, the configuration and arrangement of work cylinders is completely viable and independent of the design configuration.

I claim:

1. Press driven work tool module comprising:

a foundation body including a work cylinder defining a work space;

a work piston slidably mounted in said work space of said work cylinder;

a work ram mounted said work cylinder of said foundation body for sliding movement in non-vertical reciprocal operating and return directions, said work ram adapted for receiving a work tool;

a return spring element disposed for urging said ram in the return direction;

a hydraulic power cylinder having a displacement space containing hydraulic medium;

a plunger displaceable between a top dead center and a bottom dead center, said plunger mounted in said hydraulic power cylinder for acting upon said hydraulic medium;

a press ram disposed for acting upon said plunger;

a hydraulic pressure line communicating between the displacement space of the power cylinder and the work space of the work cylinder, wherein a supply space is provided in the power cylinder for the hydraulic medium, which supply space, when the plunger is at the top dead center, is in communication with the displacement space of the power cylinder, and which supply space is otherwise sealed off from the displacement space by high pressure seal means.

2. Work tool module according to claim 1, wherein said plunger is a plunger piston and wherein said power cylinder is comprised of a base block (1) and a guide block (2) associated with the base block (1), wherein a cylindrical bore is provided in the base block (1), which essentially represents the displacement space (24), said base block being provided with a high pressure seal ring (4) which radially seats the plunger piston (23) so long as the plunger piston is away from the top dead center thereof, and wherein further in the guide block (2) a cylinder bore is provided, of which the cross sectional diameter is greater than that of the cylinder bore in the base block (1), said cylinder bore in the guide block providing a supply space (26) for the hydraulic medium (M).

3. Work tool module according to claim 2, wherein the guide block (2) is provided with a bushing (27) for guiding of the plunger piston.

4. Work tool module according to claim 1, wherein the power cylinder (K) is provided on its surface (28) facing the press ram (17) with a height adjustable mechanical limiter (15) for limiting of the stroke of the press ram (17).

5. Work tool module according to claim 1, wherein the supply space (26) communicates from above with a low pressure valve (13) associated pressure equalization bore hole (29).

6. Work tool module according to claim 1, wherein the work space (22) communicates with an upper exhaust vent bore (30), which is closed off with a vent screw (12).

7. Work tool module according to claim 1, wherein the work cylinder includes a cylinder bore which is closed off on the work tool side with a guide box (11), in which the work ram is guided.

8. Work tool module according to claim 7, wherein the return spring element is comprised of at least a gas (G) filled torus space (31) which lies radially between the work ram and the cylinder bore of the work cylinder (A) and lies axially between the work piston (10) and the guide box (11).

9. Work tool module according to claim 8, wherein the torus space (31) is in communication with a common cavity (32) within the work piston (10) and the work ram via a bore hole (16) provided in the work piston (10).

10. Work tool module according to claim 8, wherein the torus space (31) is in communication with a common cavity (32) within the work piston (10) and the work ram via a bore hole (16) provided in the work ram.

11. Work tool module according to claim 1, wherein the return spring element is a gas spring element.

12. Work tool module according to claim 1, wherein the power cylinder (K) and the work cylinder (A) are an inseparable unitary member.

13. Work tool module according to claim 1, wherein the power cylinder (K) and the work cylinder (A) are respectively independent operable systems connected via a high pressure hydraulic line.

14. Work tool module according to claim 13, wherein the high pressure line is a flexible hose.

15. Work tool module according to claim 13, wherein a plurality of work cylinders (A) are simultaneously coupled to the power cylinder (K).

* * * * *